US005396752A

United States Patent [19]

Mastropasqua et al.

[11] Patent Number: 5,396,752

[45] Date of Patent: Mar. 14, 1995

[54] APPARATUS FOR FORMING BUNDLES OF BOXES PRODUCED BY FOLDING GLUEING OR STITCHING MACHINES AND PACKING THEM BY A STRAP

[75] Inventors: Angelo Mastropasqua, Arese; Mario Dallanegra, Cernusco Sul Naviglio; Graziano Zava, Cinisello Balsamo, all of Italy

[73] Assignee: Mega Service Di Angelo Mastropasqua & C. S.N.C., Milan, Italy

[21] Appl. No.: 74,845

[22] PCT Filed: Dec. 27, 1991

[86] PCT No.: PCT/IT91/00115

§ 371 Date: Jun. 9, 1993

§ 102(e) Date: Jun. 9, 1993

[87] PCT Pub. No.: WO92/12053

PCT Pub. Date: Jul. 23, 1992

[30] Foreign Application Priority Data

Dec. 31, 1990 [IT] Italy ..... 22576/90

[51] Int. Cl.[6] ..... B65B 27/08; B65H 31/30

[52] U.S. Cl. ..... 53/529; 53/528; 53/544; 53/589

[58] Field of Search ..... 53/528, 529, 438, 439, 53/544, 540, 531, 590, 589, 399; 100/8, 14

[56] References Cited

U.S. PATENT DOCUMENTS

| | | | |
|---|---|---|---|
| 2,947,125 | 8/1960 | Wilson et al. | 53/528 X |
| 3,225,684 | 12/1965 | Smith | 53/528 X |
| 3,307,326 | 3/1967 | Krebs | 53/528 X |
| 3,568,591 | 3/1971 | Dunlap | 100/4 |
| 3,648,431 | 3/1972 | Hartbauer et al. | 53/528 |
| 4,870,807 | 10/1989 | Palamides et al. | 53/528 |
| 5,189,864 | 3/1993 | Cinotti et al. | 53/439 |

FOREIGN PATENT DOCUMENTS

| | | |
|---|---|---|
| 2178130 | 11/1973 | France . |
| 2249009 | 5/1975 | France . |
| 2521965 | 8/1983 | France . |

*Primary Examiner*—James F. Coan

*Attorney, Agent, or Firm*—Panitch Schwarze Jacobs & Nadel

[57] ABSTRACT

Apparatus for forming and packing bundles (46) of boxes produced by a folding-glueing or stitching machine, in which a station (28) for conveying and possibly overturning at least one stack (24) of boxes which comprises substantially as many boxes as a half of those forming a bundle (46) of boxes, feeds a station (44) for matching the bundles (46) of boxes with a first and a second stack (24) of boxes whereby said two stacks (24) of boxes overlap to each other. In the matching station (44), the bundle (46) of boxes is moved along a plane inclined in the direction of movement by a pushing means (52) acting on the rear side of the bundle (46) of boxes while this is laterally guided by stationary walls (54).

7 Claims, 3 Drawing Sheets

APPARATUS FOR FORMING BUNDLES OF BOXES PRODUCED BY FOLDING GLUEING OR STITCHING MACHINES AND PACKING THEM BY A STRAP

The present invention relates to an apparatus for forming bundles of boxes produced by folding-glueing or stitching machines and packing them by a strap.

It is known that the boxes made by folding-glueing or stitching machines, i.e. the boxes not yet prepared to receive the material they will contain and which therefore are completely folded forming a substantially flat body, are packed in bundles by a strap generally made of plastics.

The above cited packing of the boxes has various problems deriving from the need to obtain a firm packing, both for transporting the bundles and storing them.

The above mentioned problems arise mainly due to the fact that the boxes to be packed have different thickness sometimes either in length or width and sometimes in both directions, whereby the stacking thereof must be accomplished in a proper way to obtain a bundle of boxes having a substantially constant height both in length and in width.

A further problem to be solved to obtain a firm packing as hereinabove pointed out derives from the fact that the stacked boxes must be overlapped to each other as correctly as possible, i.e. perfectly lined-up along the height of the pack that must have no protruding parts or portions which would prevent a correct application of the blocking strap thus making the packing of the boxes scarcely reliable.

Machines for forming bundles of boxes as hereinabove mentioned are already known but however they have remarkable drawbacks relating both to quality and reliability of the packings and or the operating possibilities that they offer and that force the user to manually operate.

A first kind of known machine essentially consists of a station for receiving the boxes made by a folding-glueing or stitching machine, in which stacks of boxes are successively formed, each of them consisting in as many boxes as a half of those forming a bundle.

Said stacks are fed to a station subsequent to the receiving one and more precisely said subsequent station is fed with a pair of stacks at a time there being provided a means which prepares said pair of stacks of boxes to form the bundle.

Said means essentially consists in a plane for supporting the stacks of boxes and tiltable by an angle of 180° so that it receives a first stack of boxes on one surface and is rotated of 180° to receive the second stack of boxes on the other surface.

Then an adequate means causes said stacks to exit from the station containing them and thus they opposedly overlap to each other as one of the stacks is rotated of 180° with respect to the other.

The overlapped stacks are taken by an operator who must manually accomplish the alignment in height and/or width i.e. the so-called matching of the boxes and obviously this manual operation causes the operating cycle time of the apparatus to increase as well as the operating costs.

Once the stacked boxes have been matched they are forwarded, again manually, to a station for applying the strap to form the bundle package.

The drawbacks of this known machine are clear both for costs as above mentioned, and due to the fact that the manual handling of the boxes does not ensure to obtain a correct packing.

Another kind of known apparatus has substantially the same drawbacks of the previous one as also therein many operating steps, particularly the matching of boxes and the forwarding thereof to the strapping station, are manually accomplished.

Also by this second kind of traditional apparatus there is formed at first a bundle of boxes consisting of two stacks of opposedly overlapped boxes and this bundle is manually formed and sent again manually to the station for applying the strap after the matching of the boxes.

Thus the drawbacks are the same and affect in the same negative way the operating costs and the manufactured product.

U.S. Pat. No. 3,568,591 discloses an apparatus for compacting and tying bundles of flat objects, with the bundles being fed along a straight horizontal path on a conveyor belt.

The object of the present invention is to provide an apparatus for forming a bundle of boxes as hereinabove indicated, by virtue of which all the operating steps for forming the bundle are automated, thus completely eliminating the manual operations necessary with the traditional apparatuses with respect to the apparatus of U.S. Pat. No. 3,568,591, The one according to the invention provides additional means for overlapping bundles and for aligning the overlapped bundles to each other before applying the packing straps, according to the features of claim 1.

The characteristics as well as the advantages of the apparatus forming the object of the present invention will be clear from the following detailed description of one non-limiting embodiment thereof, made with reference to the attached drawings in which.

Figure 1:
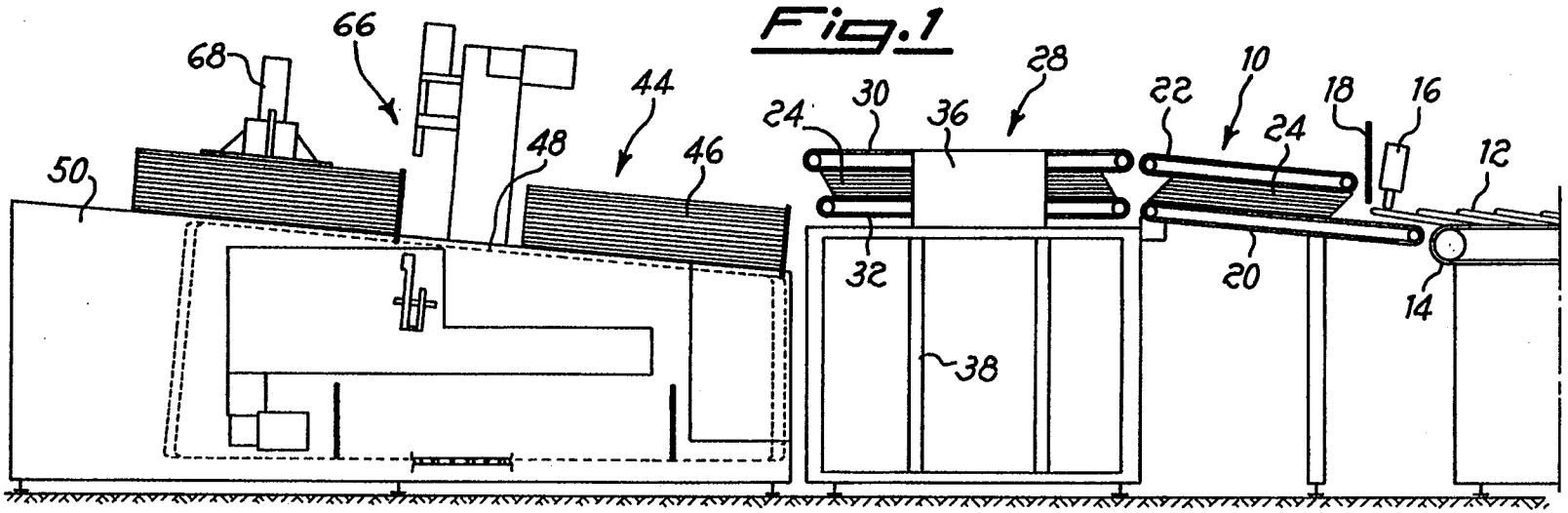
FIG. 1 is a schematic side view of the apparatus according to the present invention.
Figure 2:
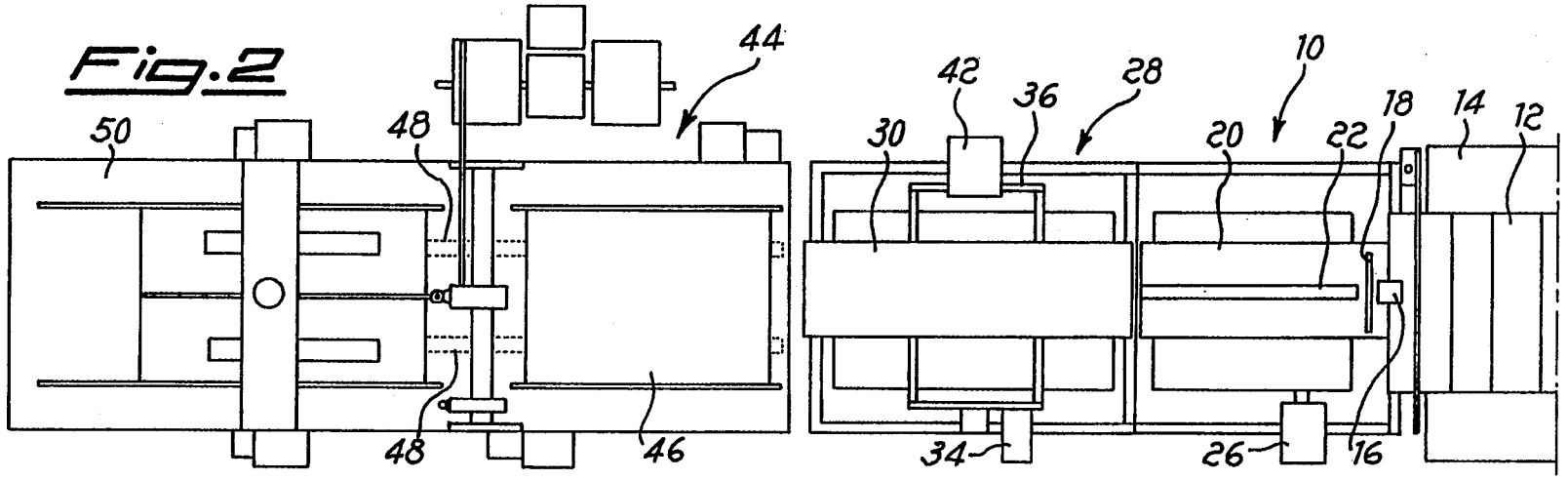
FIG. 2 is a plan schematic view of the apparatus shown in FIG. 1.
Figure 3:
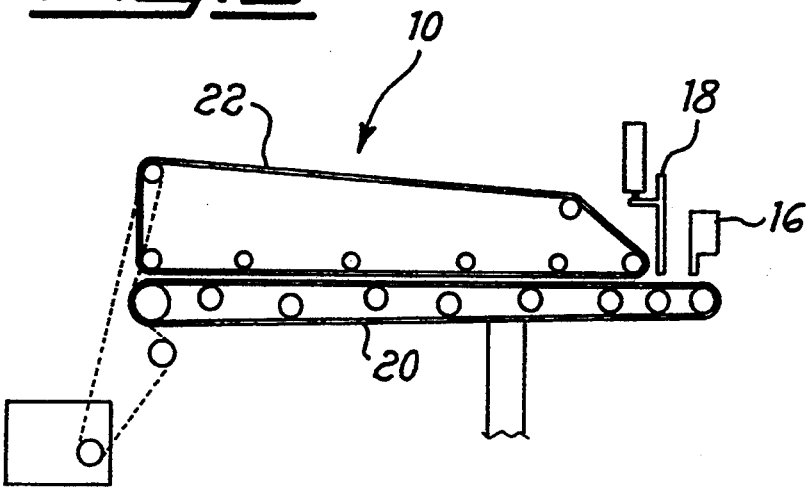
FIG. 3 is a schematic side view showing the entrance station of the apparatus for feeding the stacks of boxes to the apparatus itself.

Referring particularly to FIGS. 1 and 2 the apparatus according to the present invention essentially consists of three stations arranged in series among which the entrance station or station for feeding the stacks of boxes is designated 10 and receives boxes 12 fed by a non represented folding-glueing or stitching machine of known kind.

The boxes 12 are brought to feeding station 10 by a conveyor belt 14 and are counted by a counter 16 arranged upstream of the feeding station 10. The counter, when the number of boxes 12 reaches the one preset for forming a stack, actuates a gate 18 thus stopping the feed of boxes 12 to the feeding station 10.

The feeding station 10 essentially consists in its lower part of a conveyor belt 20 above which another conveyor belt 22 is arranged, between these elements there being formed successively and one at a time, a stack of boxes one of which is shown in FIG. 1 and designated 24.

Both first and second conveyor belt 20 and 22 of the feeding station 10 are suitably motorized and is connected in any non represented known way to an operating motor 26 which actuated when the stack of boxes 24 must be transferred to the following station for conveying and possible overturning (more specifically, flipping 180 degrees) the bundles of boxes, referenced as a whole by 28. This station is the second one of the apparatus according to the present invention.

This apparatus is shown in FIG. 1 in the condition in which a first stack of boxes 24 has been already transferred to the station 28 for conveying and possible overturning while a second stack of boxes 24 has been already formed in the feeding station 10.

The conveying and possible overturning station 28 essentially consists of two conveyor belts, upper 30 and lower 32 suitably motorized and, to such an aim, connected in any non represented known way to an operating motor 34. Obviously the different operating motors, such as motors 26 and 34, as well as the motors of the following station of the apparatus, are connected to an encoder-programming device which actuates and inhibits them in predetermined sequences suitable to allow the various stations of the apparatus to work in perfect synchronism with the folding-glueing or stitching machine.

Figure 4:
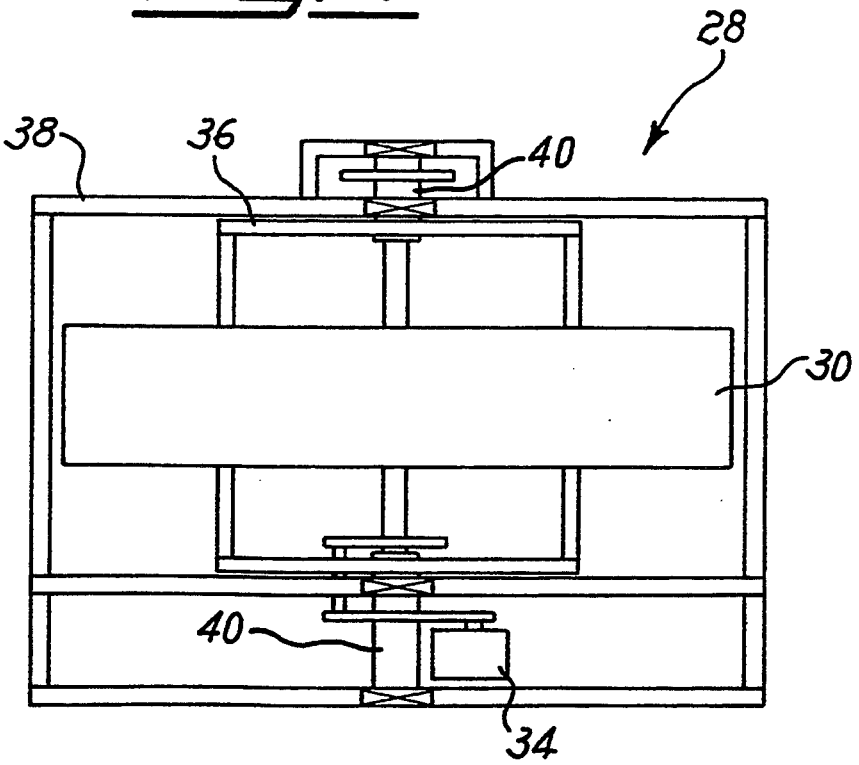
FIG. 4 is a plan schematic view showing a station for conveying and possible overturning the stacks of boxes fed by the feeding station.

The conveyor belts 30 and 32 of the conveying station 28 are supported by a frame 36 having an essentially square shape which is in turn rotatably supported by the fixed casing 38 of said station 28. In particular, as there is seen in FIG. 4, frame 36 has in a substantially median zone thereof two transverse coaxial pivots 40 rotatably mounted on the casing 38. A proper driving motor,e.g. the motor designated 42 in FIG. 2, causes pivots 40 and consequently frame 36 to rotate. This way, since rotations of 180° are allowed, the stack of boxes 24 present at the station 28 may, when required, be overturned by corresponding angle before being fed to the successive matching or aligning station.

In said successive station, which is the third and last station of the apparatus according to this invention, two operating steps are accomplished and the novel one of them is the matching of the bundle of boxes formed in this station while the other step, i.e. the application of the packing strap, takes place in a known way and thus it will not be described in detail.

Figure 5:
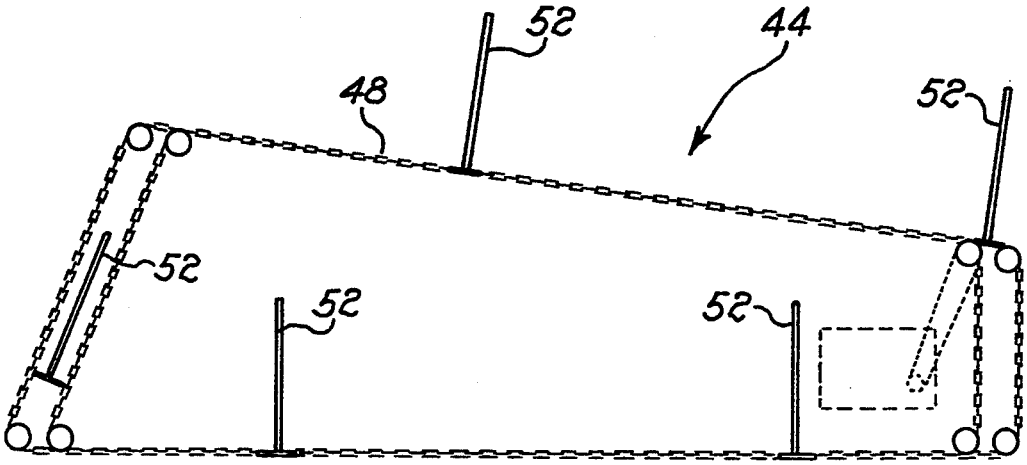
FIG. 5 is a schematic side view showing the station for matching the bundles of boxes fed by the conveying and possible overturning station.
Figure 6:
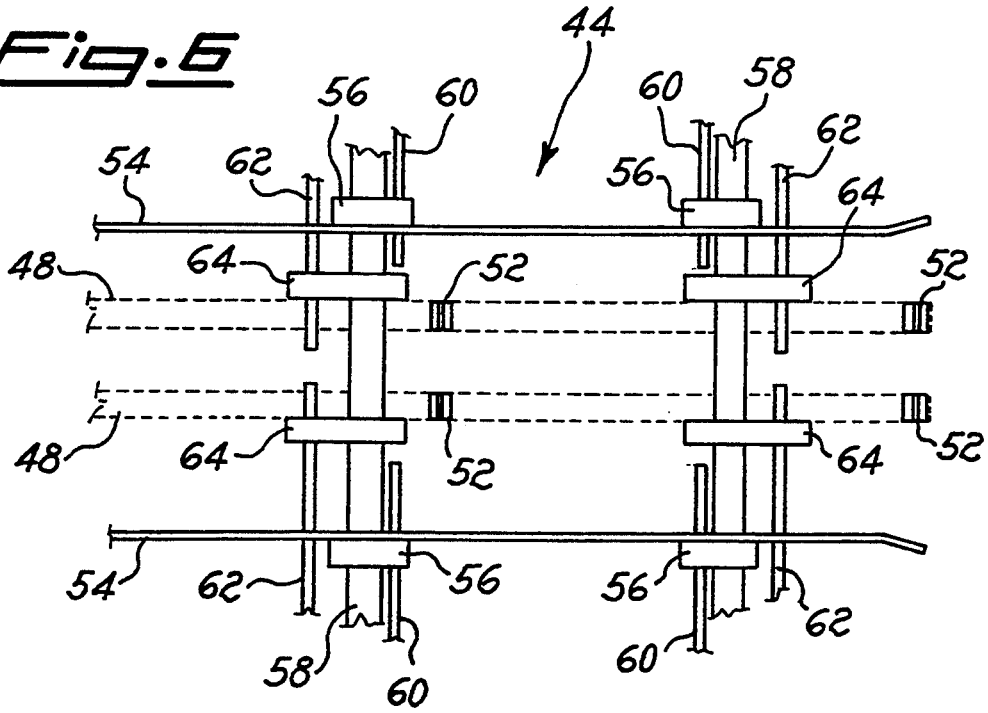
FIG. 6 is a plan schematic view showing the matching station of FIG. 5.

The third station or matching station of the apparatus according to this invention is referenced as a whole by 44 in FIGS. 1 and 2 and is shown, although schematically, more in detail in FIGS. 5 and 6.

Before describing the conformation of the matching station 44 the inventive features have to be described by which the conveying and possible overturning station 28 feeds the stacks of boxes 24 to the matching station 44.

As it was seen at the beginning of this description, each bundle of boxes to be packed substantially consists of two stacks of boxes, such as stacks 24, overlapped to each other. According to this invention the feeding of the stacks of boxes 24 to the matching station 44 may take place as hereinafter described according to the operating possibilities of the apparatus.

According to a first operating way of the apparatus according to the present invention the first stack 24 of the pair of stacks of boxes 24 intended to form a bundle of boxes and located, in FIG. 1, in the conveying station 28, is at first rotated of 180° inside said station and, successively, is fed to the matching station 44. Once the second stack of boxes 24 is brought from the feeding station 10 to the conveying station 28, this station directly discharges the second stack of boxes 24 to the matching station 44 without any overturning and thus directly overlapping the second stack of boxes 24 to the previous one.

Another operating possibility of the apparatus according to the invention consists in causing also the second stack of boxes 24 to rotate by 180° within conveying station 28, and successively feeding said second stack to the matching station 44 overlapping said stack to the first stack of boxes 24.

A third operating possibility of the apparatus according to the invention consists in directly feeding the first and the second stack of boxes 24 to the matching station 44 without any preliminary overturning of themselves.

The station 28 for conveying and possible overturning the stacks of boxes 24 is driven to operate according to either one of the two above described operations depending on the kind of boxes to be packed. The proper control signal will reach said station from the encoder central control.

The bundle of boxes now formed in station 44 and designated 46 in FIGS. 1 and 2 (in FIGS. 5 and 6 it has not been represented for the sake of illustrating clearness of the apparatus) is arranged on a supporting plane 48 which, as it is noted in particular from FIG. 1, is upwardly inclined in the feeding direction of bundle 46. The supporting plane 48 is more in particular formed of two pairs of chains schematically represented in broken line in FIGS. 5 and 6, each pair of chains extending in a ring within a support casing 50 and caused to move by non represented motor devices, e.g. toothed wheels mounted on casing 50 and driven by a motor. The upper side of chains 48 is inclined upwards thus supporting the bundle of boxes 46 which is caused to move towards the output station of the apparatus by means of suitable pushing devices hereinafter described.

Said pushing devices consist of a plurality of arms 52 for each pair of chains 48 which are fixed, at their lower end in any known way, to a link of the chains 48 in such a way that, when they move along the upper inclined path along which the bundle of boxes 46 is caused to move, they are in a substantially vertical position and particularly perpendicular to chains 48. In this condition a pair of arms 52 gets in touch with the rear side of the bundle of boxes 46 thus exerting a pushing action thereon.

As the above mentioned motion of the bundle of boxes 46 takes place along an upwardly inclined plane, due to both the weight of the stacked boxes and the pushing action of arms 52, the bundle 46 undergoes a first matching action in a longitudinal direction, i.e. along the forwarding direction thereof.

At the same time of said longitudinal matching action, bundle 46 undergoes, while advancing within station 44, a further matching action in a transverse direction which takes place thanks to a pair of stationary lateral walls 54 between which the bundle of boxes 46 moves forward.

As the crosswise size of the boxes to be packed may vary from a kind of box to another, both the distance between chains 48 and between walls 54, according to one of the inventive features of the apparatus according to the invention, may be modified.

Referring particularly to FIG. 6, there is seen that each of walls 54 is supported by a pair of sleeves 56 slidable along fixed supporting shafts 58 integral for instance to the casing 50 of station 44. The movements of sleeves 56, and therefore those of walls 54, are controlled by means adjusting screws 60 of which screw into sleeves 56 with rotations which result into shiftings in either directions of walls 54.

The transverse adjustement of chains 48 are accomplished in a similar way thanks to adjusting screws 62 which screw into corresponding supporting elements 64 of chains 48. Also these supporting elements 64 are slidable along the stationary supporting shafts 58 which bear walls 54.

In FIG. 1 in particular there is seen that, in correspondence with a substantially median zone of the matching station 44, a station 66 is provided for applying the packing strap to the bundle of boxes 46. This station, per se known, is neither described nor shown in detail.

In correspondence with the exit from station 44 a schematically represented press 68 is further noted which is actuated during the operating step of the strap application to make compact the bundle of boxes 46 and therefore to make particularly solid the packing thereof.

The advantages deriving from the use of the apparatus according to the present invention are clear from the above and can be summarized as follows:

1) production of bundles of boxes packed in a correct and particularly solid way;

2) reduction of the apparatus encumbrance with respect to the traditional machines and reduction of the need of maintenance of the apparatus itself;

3) reduction of operating times and consequent decrease of production costs;

4) total elimination of the manual operations required by the traditional apparatuses;

5) full versatility of the apparatus which is apt to operate on any kind of box.

Finally it is clear that variations and/or modifications can be brought to the apparatus object of the present invention without thereby exceeding the scope of protection of the invention itself.

We claim:

1. An apparatus for forming and packing a bundle of box flats, the apparatus comprising:

a feeding station having a first generally horizontal conveying means for sequentially receiving a selected number of box flats into a stack and for moving the stack from the feeding station;

a conveying station in communication with the feeding station and having a rotatable portion for receiving the stack, selectively flipping the received stack, and moving the received stack from the conveying station; and a matching station in communication with the conveying station and having a second generally upwardly inclined conveying means for receiving at least one stack from the conveying station into the bundle, the second conveying means including a pushing means for pushing the bundle forwardly to undergo a longitudinal aligning, the matching station also having a pair of stationary lateral walls between which the bundle is pushed to undergo a lateral aligning, the pushing means also for pushing the bundle to a pressing station for compacting the bundle and to a strapping station for applying a packing strap to the bundle, the pushing means comprising at least one arm generally vertically extending from the second conveying means.

2. The apparatus of claim 1 wherein the rotatable portion of the conveying station includes a rotatable frame comprising third generally horizontal conveying means having a generally planar conveying surface and a fourth generally horizontal conveying means having a generally planar conveying surface generally parallel to and in facing relationship with the conveying surface of the third conveying means to form an area therebetween, one of the third and the fourth conveying means for receiving the stack from the feeding station such that the received stack is positioned in the area when the rotatable frame selectively flips, the one of the third and the fourth conveying means for moving the stack from the conveying station if the received stack is not flipped and the other of the third and the fourth conveying means for moving the stack from the conveying station if the received stack is flipped.

3. The apparatus of claim 1 wherein the pushing means comprises at least one pair of laterally positioned arms.

4. The apparatus of claim 3 wherein the pushing means comprises a plurality of pairs of laterally positioned arms.

5. The apparatus of claim 3 wherein the pair of arms are laterally adjustable and wherein the pushing means further comprises securing means for releasably securing the arms in any of a plurality of lateral positions.

6. The apparatus of claim 1 wherein the stationary lateral walls are laterally adjustable and include securing means for releasably securing the walls in any of a plurality of lateral positions.

7. The apparatus of claim 1 wherein the second conveying means is for receiving at least one flipped stack and at least one un-flipped stack from the conveying station.

* * * * *